US011976657B2

(12) United States Patent
Baba

(10) Patent No.: US 11,976,657 B2
(45) Date of Patent: May 7, 2024

(54) COMPRESSOR AND AIR CONDITIONER

(71) Applicant: Mitsubishi Electric Corporation, Tokyo (JP)

(72) Inventor: Kazuhiko Baba, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 104 days.

(21) Appl. No.: 17/425,489

(22) PCT Filed: Feb. 13, 2019

(86) PCT No.: PCT/JP2019/005004

§ 371 (c)(1),
(2) Date: Jul. 23, 2021

(87) PCT Pub. No.: WO2020/165962

PCT Pub. Date: Aug. 20, 2020

(65) Prior Publication Data

US 2022/0099080 A1 Mar. 31, 2022

(51) Int. Cl.
*F03C 2/00* (2006.01)
*F03C 4/00* (2006.01)
(Continued)

(52) U.S. Cl.
CPC ..... *F04C 18/3564* (2013.01); *F04B 39/0094* (2013.01); *F04C 18/356* (2013.01);
(Continued)

(58) Field of Classification Search
CPC .. F04C 18/356; F04C 18/3564; F04C 23/008; F04C 29/0071; F04C 29/0078;
(Continued)

(56) References Cited

U.S. PATENT DOCUMENTS 4,272,971 A * 6/1981 Loyd ..... B29C 63/0021 464/181
4,702,782 A * 10/1987 Chin ..... C22C 19/007 148/426
(Continued)

FOREIGN PATENT DOCUMENTS

JP H04-103886 A 4/1992
JP H04-080247 U 7/1992
(Continued)

OTHER PUBLICATIONS

JP-2000227083-A—Ezumi Mototaka—Rotary Compressor—Aug. 15, 2000—The English Machine Translation. (Year: 2000).*
(Continued)

*Primary Examiner* — Theresa Trieu
(74) *Attorney, Agent, or Firm* — POSZ LAW GROUP, PLC

(57) ABSTRACT

A compressor includes a motor, a compression mechanism portion driven by the motor, and a rotation shaft connecting the motor and the compression mechanism portion. At least a part of the rotation shaft is composed of a material having a higher Young's modulus than that of cast iron, and having a higher thermal conductivity than that of cast iron.

13 Claims, 8 Drawing Sheets

(51) Int. Cl.

| | |
|---|---|
| ***F04B 39/00*** | (2006.01) |
| ***F04C 2/00*** | (2006.01) |
| ***F04C 18/356*** | (2006.01) |
| ***F04C 29/00*** | (2006.01) |
| *F04C 23/00* | (2006.01) |

(52) U.S. Cl.
CPC ..... *F04C 29/0071* (2013.01); *F04C 29/0078* (2013.01); *F04C 23/008* (2013.01); *F04C 2240/56* (2013.01); *F04C 2240/60* (2013.01)

(58) Field of Classification Search
CPC ..... F04C 2240/56; F04C 2240/60; F04B 39/0094; F04B 2203/0203; F05C 2201/0439; F05C 2253/04; B29C 63/0021; B29C 66/612; B64C 27/12
See application file for complete search history.

(56) References Cited

U.S. PATENT DOCUMENTS

| | | | | |
|---|---|---|---|---|
| 6,302,665 | B1 * | 10/2001 | Esumi | F04C 18/3564 418/63 |
| 6,863,763 | B2 * | 3/2005 | Lee | F16C 3/026 464/181 |
| 7,938,628 | B2 * | 5/2011 | Lin | B64C 27/12 416/500 |
| 9,821,520 | B2 * | 11/2017 | Kendrick | B29C 66/612 |
| 2014/0060708 | A1 | 3/2014 | Shah et al. | |
| 2016/0181877 | A1 * | 6/2016 | Ishikawa | H02K 1/276 310/156.08 |

FOREIGN PATENT DOCUMENTS

| | | | | | |
|---|---|---|---|---|---|
| JP | 2000227083 | A | * | 8/2000 | F04C 18/356 |
| JP | 2001289169 | A | * | 10/2001 | F04C 18/0215 |
| JP | 2005-207429 | A | | 8/2005 | |
| JP | 2005-248843 | A | | 9/2005 | |
| JP | 2009-275645 | A | | 11/2009 | |
| JP | 2010068600 | A | * | 3/2010 | H02K 1/2766 |
| JP | 2015-028300 | A | | 2/2015 | |
| JP | 2015-534602 | A | | 12/2015 | |
| JP | 2016-208724 | A | | 12/2016 | |
| WO | WO-2018131436 | A1 | * | 7/2018 | F04C 18/356 |
| WO | 2018/146764 | A1 | | 8/2018 | |

OTHER PUBLICATIONS

JP-2001289169-A—Fukuhara Hiroyuki—Compressor—Oct. 19, 2001—The English Machine Translation. (Year: 2001).*

JP-2010068600-A—Baba Kazuhiro—Permanent Magnet Motor and Hermetic Compressor—Mar. 25, 2010—The English Machine Translation. (Year: 2010).*

WO-2018131436-A1—Tomioka Naoto—Compressor Comprising Shaft Support—Jul. 7, 2018—The English Machine Translation. (Year: 2018).*

JP02153288A—Nakada et al.—Rotary Compressor—Jun. 12, 1990—English Machine Translation. (Year: 1990).*

JP2000097183A—Sawara et al.—Rotary Compressor—Apr. 4, 2000—English Machine Translation. (Year: 2000).*

International Search Report dated May 21, 2019, in corresponding International Application PCT/JP2019/005004 (and English translation).

* cited by examiner

COMPRESSOR AND AIR CONDITIONER

CROSS REFERENCE TO RELATED APPLICATION

This application is a U.S. national stage application of International Patent Application No. PCT/JP2019/005004 filed on Feb. 13, 2019, the disclosure of which is incorporated herein by reference.

TECHNICAL FIELD

The present invention relates to a compressor and an air conditioner.

BACKGROUND

A compressor for use in an air conditioner or the like includes a compression mechanism portion, a motor, and a rotation shaft connecting the compression mechanism portion and the motor. The rotation shaft is supported at one end thereof by a bearing portion provided in the compression mechanism portion (see, for example, Patent Reference 1).

PATENT REFERENCE

Patent Reference 1: Japanese Patent Application Publication No. 2005-248843 (see FIG. 1)

In order to increase an output of a compressor, it is necessary to increase a stroke capacity of the compressor and to rotate a rotor at a high speed. In this case, however, an increased torque and an increased centrifugal force may cause the rotor to whirl, and thus vibration and noise of the compressor may increase. In addition, as a rotation speed increases, an iron loss in the rotor increases, and accordingly a temperature of the rotor rises. Thus, permanent magnets attached to the rotor may be demagnetized, and a sliding loss between the rotation shaft and the bearing portion may increase.

Therefore, it is required to reduce vibration and noise of the compressor and to suppress a temperature rise of the compressor.

SUMMARY

The present invention is made to solve the problem described above, and an object of the present invention is to reduce vibration and noise of a compressor and to suppress a temperature rise of the compressor.

A compressor according to an aspect of the present invention includes a motor, a compression mechanism portion driven by the motor, and a rotation shaft connecting the motor and the compression mechanism portion. The rotation shaft has a first shaft portion on an inner side in a radial direction about a rotation center of the rotation shaft, and has a second shaft portion on an outer side of the first shaft portion in the radial direction. The first shaft portion is composed of a material having a higher Young's modulus than that of cast iron, and having a higher thermal conductivity than that of cast iron.

According to the present invention, at least a part of the rotation shaft is composed of a material having a higher Young's modulus than that of cast iron and having a higher thermal conductivity than that of cast iron. Thus, vibration and noise of the compressor can be reduced, and a temperature rise of the compressor can be suppressed.

DETAILED DESCRIPTION

Embodiments of the present invention will be described in detail with reference to the drawings. These embodiments are not intended to limit the present invention.

First Embodiment (Configuration of Compressor)

Figure 1:
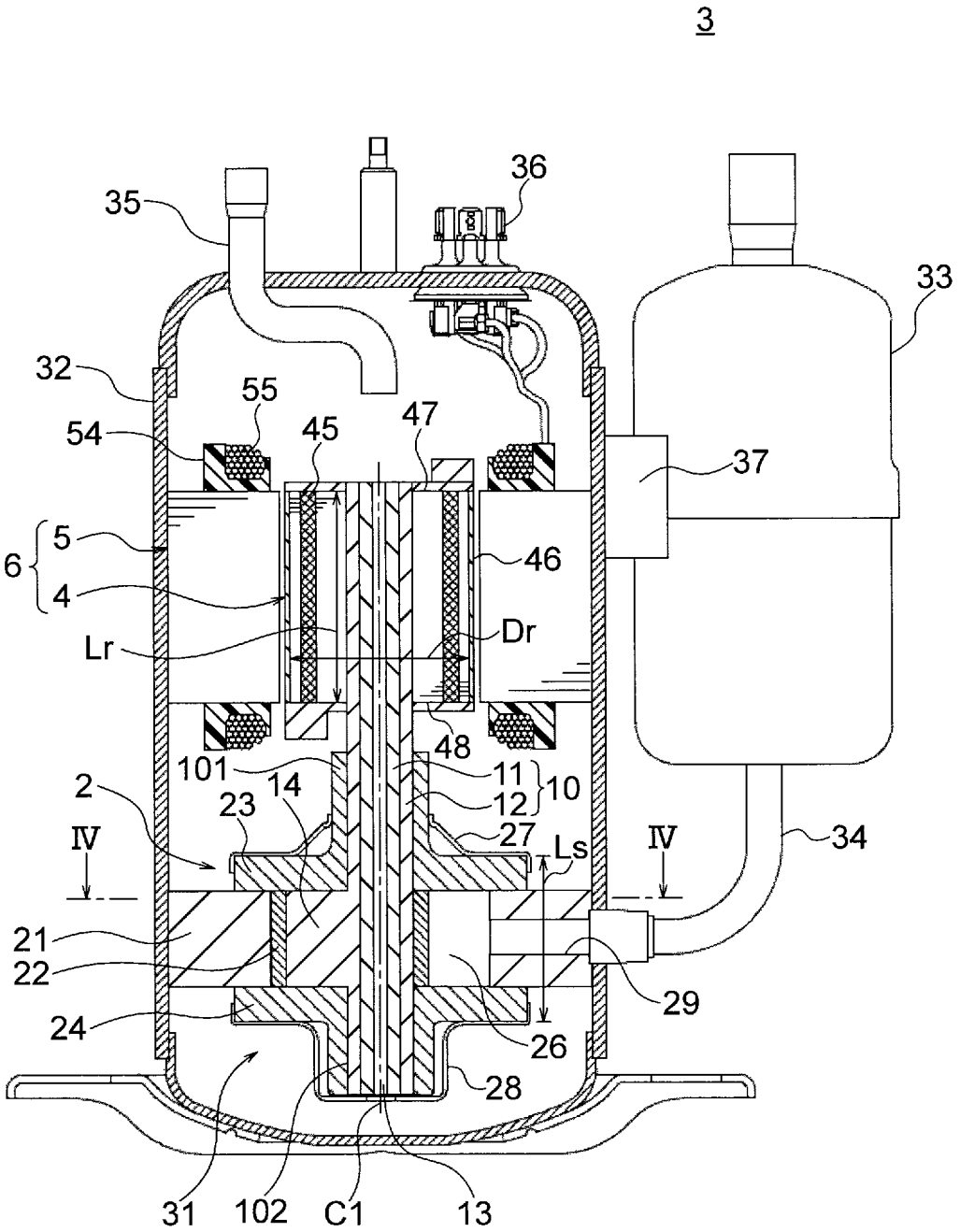
FIG. 1 is a longitudinal sectional view illustrating a compressor according to a first embodiment.

FIG. 1 is a longitudinal sectional view illustrating a compressor 3 according to a first embodiment. The compressor 3 is a rotary compressor. The compressor 3 includes a compression mechanism portion 31, a motor 6 that drives the compression mechanism portion 31, a rotation shaft 10 connecting the compression mechanism portion 31 and the motor 6, and a closed container 32 that accommodates these components. In this example, an axial direction of the rotation shaft 10 is a vertical direction, and the motor 6 is disposed above the compression mechanism portion 31.

In the following description, a direction of an axis C1 that is a rotation center of the rotation shaft 10 will be referred to as an "axial direction." A radial direction about the axis C1 will be referred to as a "radial direction," and a circumferential direction (indicated by arrow R1 in FIG. 2) about the axis C1 will be referred to as a circumferential direction. A sectional view in a plane parallel to the axis C1 will be referred to as a longitudinal sectional view, and a sectional view in a plane perpendicular to the axis C1 will be referred to as a cross sectional view.

(Configuration of Motor)

Figure 2:
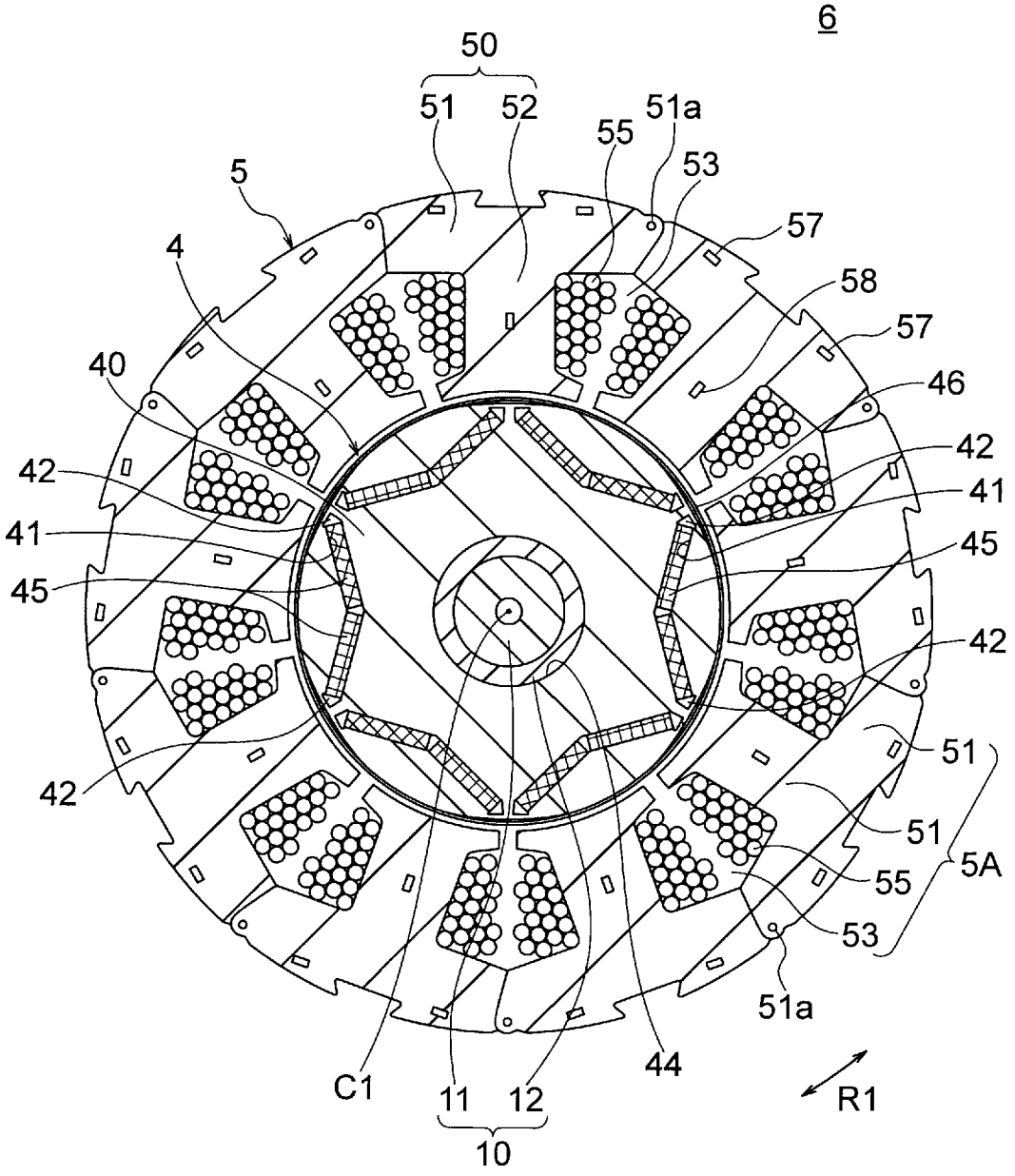
FIG. 2 is a cross sectional view illustrating a motor according to the first embodiment.

FIG. 2 is a cross sectional view illustrating the motor 6. The motor 6 is a motor of a so-called inner rotor type, and includes a stator 5 and a rotor 4 rotatably disposed on the inner side of the stator 5. A gap of, for example, 0.3 to 1.0 mm is formed between the rotor 4 and the stator 5.

The rotor 4 includes a cylindrical rotor core 40 and permanent magnets 45 attached to the rotor core 40. The rotor core 40 is formed by stacking a plurality of electromagnetic steel sheets in the axial direction and integrating the electromagnetic steel sheets by crimping or the like. The thickness of each electromagnetic steel sheet is 0.1 to 0.7 mm, and is 0.35 mm in this example. A shaft hole 44 is formed at the center of the rotor core 40 in the radial direction. The above described rotation shaft 10 is fixed to the shaft hole 44 by shrink fitting, press fitting, adhesion or the like.

A plurality of magnet insertion holes 41 in which the permanent magnets 45 are inserted are formed along the outer circumference of the rotor core 40. The number of magnet insertion holes 41 is six in this example. The number of magnet insertion holes 41, however, is not limited to six, and only needs to be two or more. One magnet insertion hole 41 corresponds to one magnetic pole, and a portion between each adjacent two of the magnet insertion holes 41 corresponds to an inter-pole portion. Each of the magnet insertion holes 41 has a V shape whose center portion in the circumferential direction projects inward in the radial direction.

Two permanent magnets 45 are inserted in each of the magnet insertion holes 41. Each permanent magnet 45 has a width in the circumferential direction of the rotor core 40 and has a thickness in the radial direction. The thickness of each of the permanent magnets 45 is greater than or equal to 2.5 times a gap between the rotor 4 and the stator 5, and is 2 mm, for example.

Each permanent magnet 45 is, for example, a rare earth magnet containing neodymium (Nd), iron (Fe), and boron (B) as main components. The permanent magnet 45 contains no heavy rare earth element such as dysprosium (Dy) or terbium (Tb), or contains 2 weight percent or less of the heavy rare earth element.

Each permanent magnet 45 is magnetized in the thickness direction. Two permanent magnets 45 inserted in the same magnet insertion hole 41 have the same magnetic poles on the outer side in the radial direction. The permanent magnets 45 inserted in adjacent magnet insertion holes 41 have opposite magnetic poles on the outer side in the radial direction. The shape of each magnet insertion hole 41 is not limited to the V shape. It is sufficient that at least one permanent magnet 45 is disposed in each magnet insertion hole 41.

Flux barriers 42 serving as leakage magnetic flux reduction holes are formed at both ends of each magnet insertion hole 41 in the circumferential direction. A core portion between each flux barrier 42 and the outer circumference of the rotor core 40 is a thin portion so as to reduce leakage magnetic flux between adjacent magnetic poles.

An outer diameter Dr (FIG. 1) of the rotor core 40 is smaller than or equal to an inner diameter Ds (FIG. 4) of a cylinder chamber 26 described later. A length Lr (FIG. 1) of the rotor core 40 in the axial direction is longer than the outer diameter Dr of the rotor core 40. Accordingly, a torque of the motor 6 can be increased while reducing a centrifugal force of the rotor 4 in high-speed rotation.

End plates 47 and 48, each of which is in the form of a disk, are fixed to both ends of the rotor 4 in the axial direction in order to prevent detachment of the permanent magnets 45 from the magnet insertion holes 41. The end plates 47 and 48 are provided with balance weights for enhancing rotation balance of the rotor 4.

In order to increase rigidity, the rotor 4 includes a cylindrical holding portion 46 covering the outer circumference of the rotor core 40. The holding portion 46 is fixed to the outer circumference of the rotor core 40 by an adhesive agent, press fitting, shrink fitting, or cool fitting. The holding portion 46 is composed of, for example, carbon fiber reinforced plastic (CFRP), stainless steel, or a resin.

The stator 5 includes a stator core 50 and a coil 55 wound on the stator core 50. The stator core 50 is formed by stacking a plurality of electromagnetic steel sheets in the axial direction and integrating the electromagnetic steel sheets by crimping or the like. The thickness of each electromagnetic steel sheet is 0.1 to 0.5 mm, and is 0.25 mm in this example.

The thickness of each electromagnetic steel sheet of the stator core 50 is preferably thinner than the thickness of each electromagnetic steel sheet of the rotor core 40. In the stator 5, an iron loss tends to be larger than that in the rotor 4. A temperature rise of the stator 5 can be suppressed by using the thinner electromagnetic steel sheets.

The stator core 50 includes a yoke 51 having an annular shape about the axis C1, and a plurality of teeth 52 extending inward in the radial direction from the yoke 51. The teeth 52 are arranged at regular intervals in the circumferential direction. The number of teeth 52 is nine in this example. The number of the teeth 52, however, is not limited to nine, and only needs to be two or more. A slot 53 that is a space for accommodating the coil 55 is formed between each two of the teeth 52 adjacent to each other in the circumferential direction.

In this example, the stator core 50 has a configuration in which a plurality of split cores 5A each including one tooth 52 are connected to one another in the circumferential direction. The number of split cores 5A is equal to the number of teeth 52. The split cores 5A are connected to one another at connecting portions 51*a* disposed at end portions of the yoke 51 on the outer circumference side. In this regard, the stator core 50 is not limited to the configuration in which the split cores 5A are connected.

An insulating portion 54 (FIG. 1) composed of a resin such as polybutylene terephthalate (PBT) is provided between the core 50 and the coil 55. The insulating portion 54 is formed by attaching a resin molded body to the stator core 50 or by molding the stator core 50 integrally with the resin.

The stator core 50 is incorporated in the closed container 32 (FIG. 1) of the compressor 3 by shrink fitting, press fitting, welding or the like.

(Configuration of Compression Mechanism portion)

As illustrated in FIG. 1, the compression mechanism portion 31 includes a cylinder 21 including a cylinder chamber 26, a rolling piston 22 fixed to the rotation shaft 10, a vane 25 (FIG. 4) dividing the inside of the cylinder chamber 26 into a suction side and a compression side, and an upper frame 23 and a lower frame 24 that close ends of the cylinder chamber 26 in the axial direction. An upper discharge muffler 27 and a lower discharge muffler 28 are attached to the upper frame 23 and the lower frame 24, respectively.

The closed container 32 is a cylindrical container formed by drawing a steel sheet. The stator 5 of the motor 6 is incorporated inside the closed container 32 by shrink fitting, press fitting, welding or the like. In the bottom portion of the closed container 32, refrigerating machine oil as lubricant for lubricating sliding portions of the compression mechanism portion 31 is stored.

An upper portion of the closed container 32 is provided with a discharge pipe 35 through which refrigerant is discharged to the outside, and a terminal 36 for supplying electric power to the coil 55 of the stator 5. An accumulator 33 that stores refrigerant gas is fixed to the outside of the closed container 32 via a fixing portion 37.

Figure 3:
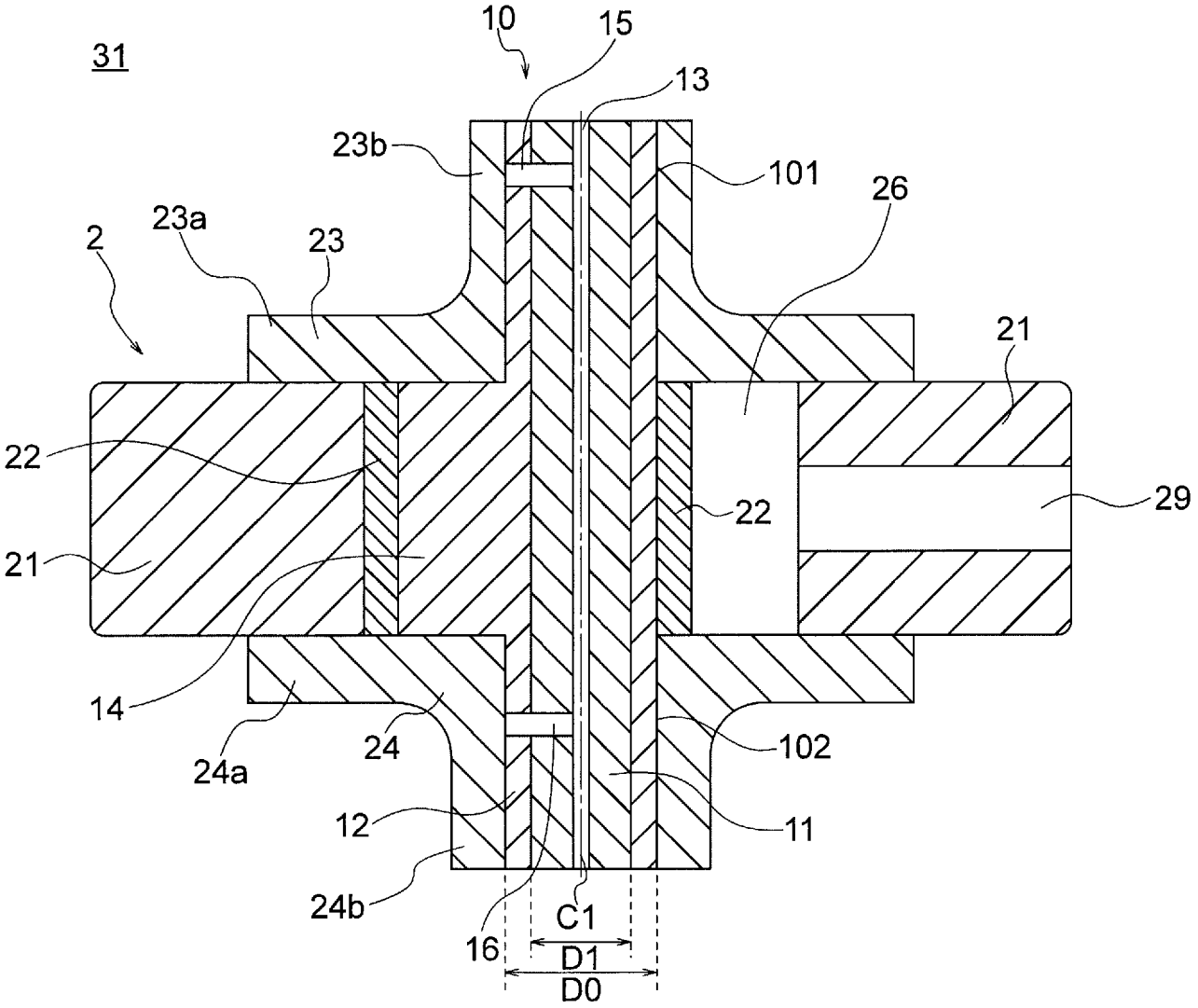
FIG. 3 is a longitudinal sectional view illustrating a compression mechanism portion according to the first embodiment.
Figure 4:
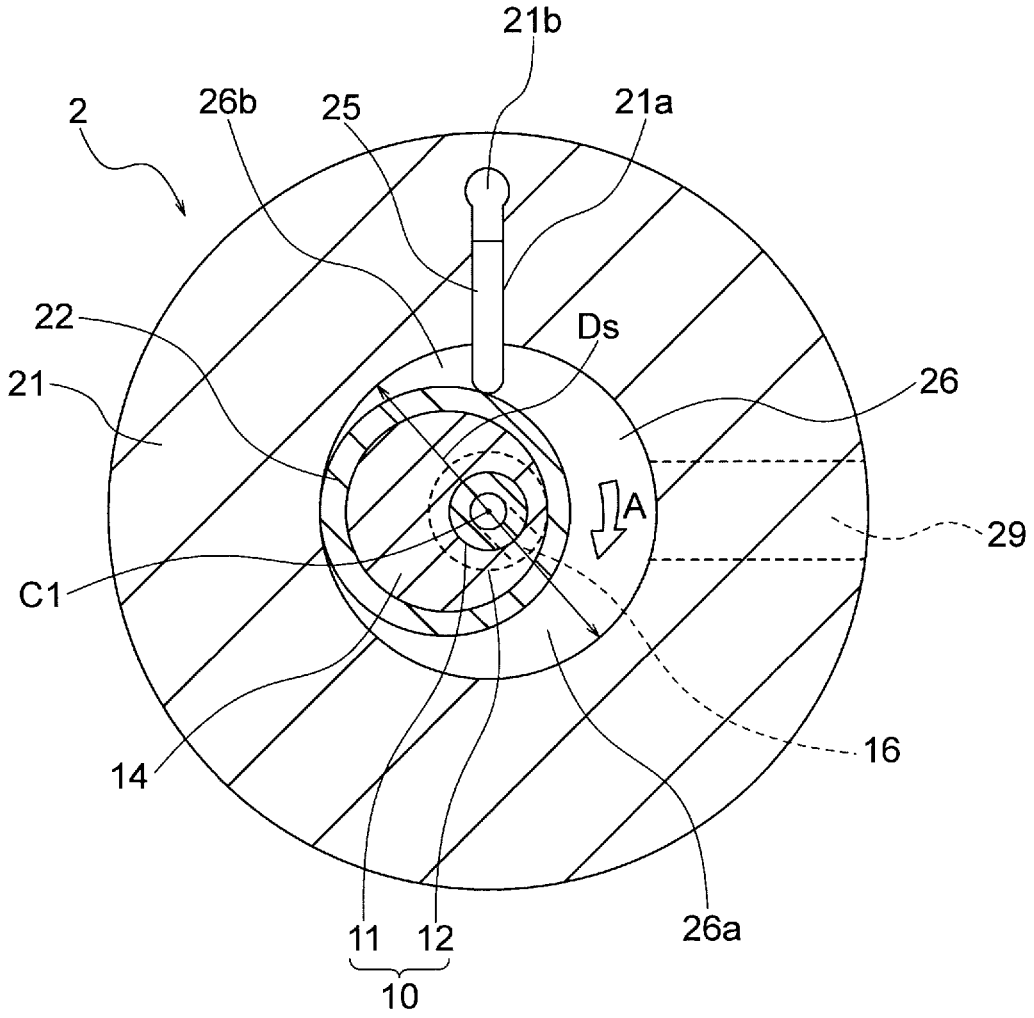
FIG. 4 is a cross sectional view illustrating the compression mechanism portion according to the first embodiment.

FIG. 3 is a longitudinal sectional view illustrating the compression mechanism portion 31. FIG. 4 is a cross sectional view illustrating the compression mechanism portion 31 taken along line IV-IV in FIG. 1. The cylinder 21 of the compression mechanism portion 31 includes a cylinder chamber 26 having a cylindrical shape about the axis C1.

The rotation shaft 10 includes an eccentric shaft portion 14 located inside the cylinder chamber 26. The eccentric shaft portion 14 includes a cylindrical part having a center axis which is eccentric with respect to the axis C1.

The rolling piston 22 having a ring shape is fitted onto the outer circumference of the eccentric shaft portion 14. When the rotation shaft 10 rotates, the eccentric shaft portion 14 and the rolling piston 22 rotate about the center axis which is eccentric with respect to the axis C1 inside the cylinder chamber 26.

A portion of the rotation shaft 10 on the motor 6 side with respect to the eccentric shaft portion 14 will be referred to as a main shaft portion 101. A portion of the rotation shaft 10 on a side opposite to the main shaft portion 101 with respect to the eccentric shaft portion 14 will be referred to as an auxiliary shaft portion 102. In this example, the main shaft portion 101 is located at an upper side, and the auxiliary shaft portion 102 is located at a lower side. Centers of the main shaft portion 101 and the auxiliary shaft portion 102 are located on the axis C1. A center hole 13 is formed along the axis C1 at the center of the rotation shaft 10.

The upper frame 23 includes a flat plate portion 23*a* that closes the upper end of the cylinder chamber 26, and a bearing portion 23*b* rotatably supporting the main shaft portion 101 of the rotation shaft 10. The bearing portion 23*b* is a slide bearing. The upper frame 23 is composed of iron such as cast iron, and fixed to the upper surface of the cylinder 21 using, for example, bolts or the like.

Refrigerating machine oil stored in the bottom portion of the closed container 32 is supplied to between the bearing portion 23*b* of the upper frame 23 and the main shaft portion 101 through the center hole 13 and an oil supply path 15 of the rotation shaft 10. The main shaft portion 101 is rotatably supported by the bearing portion 23*b* with fluid lubrication of an oil film of the refrigerating machine oil.

The lower frame 24 includes a flat plate portion 24*a* that closes the lower end of the cylinder chamber 26, and a bearing portion 24*b* rotatably supporting the auxiliary shaft portion 102 of the rotation shaft 10. The bearing portion 24*b* is a slide bearing. The lower frame 24 is composed of iron such as cast iron, and fixed to the lower surface of the cylinder 21 using, for example, bolts or the like.

The refrigerating machine oil stored in the bottom portion of the closed container 32 is supplied to between the bearing portion 24*b* of the lower frame 24 and the auxiliary shaft portion 102 through the center hole 13 and an oil supply path 16 of the rotation shaft 10. The auxiliary shaft portion 102 is rotatably supported by the bearing portion 24*b* with fluid lubrication of an oil film of the refrigerating machine oil.

As illustrated in FIG. 4, the cylinder 21 includes a vane trench 21*a* extending in the radial direction about the axis C1. One end of the vane trench 21*a* communicates with the cylinder chamber 26, and the other end of the vane trench 21*a* communicates with a back pressure chamber 21*b*. The vane 25 is inserted in the vane trench 21*a*. The vane 25 is capable of reciprocating in the vane trench 21*a*. The back pressure chamber 21*b* is provided with a spring which pushes the vane 25 from the vane trench 21*a* into the cylinder chamber 26 so that an end of the vane 25 is brought into contact with the outer circumferential surface of the rolling piston 22.

The vane 25 partitions a space formed by the inner circumferential surface of the cylinder chamber 26 and the outer circumferential surface of the rolling piston 22, into two operation chambers. One of the two operation chambers that communicates with a suction port 29 functions as a suction chamber 26*a* into which low-pressure refrigerant gas is sucked, and the other operation chamber functions as a compression chamber 26*b* that compresses the refrigerant. The cylinder 21 has the suction port 29 through which the refrigerant gas is sucked into the cylinder chamber 26 from the outside of the closed container 32. The suction port 29 communicates with the suction chamber 26*a* in the cylinder chamber 26.

The suction port 29 is connected to a suction pipe 34 of the accumulator 33 (FIG. 1). The compressor 3 is supplied with a mixture of low-pressure refrigerant gas and liquid refrigerant from a refrigerant circuit of an air conditioner 7. When the liquid refrigerant flows into the compression mechanism portion 31 and is compressed therein, it may cause a malfunction of the compression mechanism portion 31. Thus, the liquid refrigerant and the refrigerant gas are separated in the accumulator 33, and only the refrigerant gas is supplied to the compression mechanism portion 31.

The upper frame 23 has an outlet port through which the refrigerant gas compressed in the compression chamber 26*b* (FIG. 4) of the cylinder chamber 26 is discharged to the outside of the cylinder chamber 26. The outlet port is provided with a discharge valve. The discharge valve opens when the pressure of the refrigerant gas compressed in the compression chamber 26*b* of the cylinder chamber 26 reaches a specified pressure or more, and the refrigerant gas is discharged into the closed container 32.

The refrigerant gas discharged into the closed container 32 from the cylinder chamber 26 flows to an upper portion of the closed container 32. The refrigerant gas flows upward through the gap between the rotor 4 and the stator 5 of the motor 6 and a gap between the stator 5 and the inner circumferential surface of the closed container 32, and is sent to the outside of the closed container 32 through the discharge pipe 35.

For example, R410A, R407C, and R22 or the like is used as the refrigerant. From the viewpoint of preventing global warming, it is preferable to use refrigerant whose global warming potential (GWP) is low.

The length Lr of the rotor core 40 in the axial direction is preferably longer than or equal to the length Ls of the cylinder 21 of the compression mechanism portion 31 in the axial direction, and more preferably longer than or equal to twice the length Ls of the cylinder 21 in the axial direction. As the length Lr of the rotor core 40 in the axial direction increases, the length of each permanent magnet 45 in the axial direction increases and a magnetic force increases. Accordingly, a torque increases.

(Configuration of Rotation Shaft)

The rotation shaft 10 includes a first shaft portion 11 and a second shaft portion 12. The first shaft portion is located on the inner side in the radial direction, and the second shaft portion 12 is located on the outer side in the radial direction. Each of the first shaft portion 11 and the second shaft portion 12 is formed to extend from one end to the other end of the rotation shaft 10 in the axial direction, that is, from the lower end to the upper end in FIG. 1.

The first shaft portion 11 is composed of a material whose Young's modulus and thermal conductivity are higher than those of cast iron. The material whose Young's modulus and thermal conductivity are higher than those of cast iron is, for example, carbon fiber reinforced plastic (CFRP). On the other hand, the second shaft portion 12 is composed of iron, more specifically, cast iron.

The carbon fiber reinforced plastic preferably includes pitch carbon fibers having a fiber length of 50 μm to 3 μm and a thermoplastic resin such as polyethylene terephthalate (PET) or polybutylene terephthalate (PBT). The pitch carbon fibers are preferably of an ultra-high modulus type.

The Young's modulus of cast iron is 100 to 170 [GPa]. The Young's modulus of carbon fiber reinforced plastic is 300 to 900 [GPa]. That is, the Young's modulus of carbon fiber reinforced plastic is three to five times the Young's modulus of cast iron.

The thermal conductivity of cast iron is 40 to 50 [W/mK]. The thermal conductivity of carbon fiber reinforced plastic is 150 to 900 [W/mK]. That is, the thermal conductivity of carbon fiber reinforced plastic is 3 to 18 times the thermal conductivity of cast iron.

The rotation shaft 10 having the configuration described above is made by inserting the first shaft portion 11 composed of carbon fiber reinforced plastic into the second shaft portion 12 composed of a casting of cast iron so that the first shaft portion 11 serves as a core rod.

The cast iron is a material used for a rotation shaft of a general compressor. It can be said that the first shaft portion 11 of the rotation shaft 10 is composed of a material whose Young's modulus and thermal conductivity are higher than those of the material used for the rotating shaft of the general compressor. On the other hand, it can be said that the second shaft portion 12 is composed of a material similar to the material used for the rotation shaft of the general compressor.

Since the first shaft portion 11 is composed of the material whose Young's modulus and thermal conductivity are higher than those of cast iron, deflection of the rotation shaft 10 can be suppressed and vibration and noise can be reduced. In addition, heat due to an iron loss in the rotor 4 and a sliding loss can be dissipated through the rotation shaft 10, and a temperature rise of the rotor 4 can be suppressed.

In a cross section perpendicular to the axial direction, an outer diameter D1 of the first shaft portion 11 is smaller than 90% of an outer diameter D0 of the rotation shaft 10 ($D1<0.9\times D0$). Since the thickness of the second shaft portion 12 is not excessively thin, the second shaft portion 12 can be prevented from separating from the first shaft portion 11.

(Operation of Compressor)

Next, an operation of the compressor 3 will be described. When a current is supplied to the coil 55 of the stator 5 via the terminal 36, a magnetic field generated by the current of the coil 55 and a magnetic field of the permanent magnets 45 of the rotor 4 cause an attraction force and a repulsive force between the stator 5 and the rotor 4 so that the rotor 4 rotates. Accordingly, the rotation shaft 10 fixed to the rotor 4 also rotates.

In the cylinder chamber 26, the eccentric shaft portion 14 of the rotation shaft 10 and the rolling piston 22 attached to the eccentric shaft portion 14 rotate in a direction indicated by an arrow A in FIG. 4 about the axis eccentric with respect to the axis C1. The eccentric rotation of the eccentric shaft portion 14 and the rolling piston 22 in the cylinder chamber 26 causes the operation chamber communicating with the suction port 29 to function as the suction chamber 26*a* to suck low-pressure refrigerant gas.

The refrigerant gas in the accumulator 33 is supplied to the suction chamber 26*a* of the cylinder chamber 26 through the suction pipe 34. The suction chamber 26*a* supplied with the refrigerant gas moves in the cylinder chamber 26 by the eccentric rotation of the eccentric shaft portion 14 and the rolling piston 22, and communication with the suction port 29 is interrupted. Thereafter, the suction chamber 26*a* functions as the compression chamber 26*b*. The eccentric rotation of the eccentric shaft portion 14 and the rolling piston 22 reduces the volume of the compression chamber 26*b* so that the refrigerant gas is compressed.

As the eccentric rotation of the eccentric shaft portion 14 and the rolling piston 22 proceeds, the compression chamber 26*b* comes to communicate with the outlet port. Accordingly, the high-pressure refrigerant gas in the compression chamber 26*b* is discharged into the closed container 32 through the outlet port. When the eccentric rotation of the eccentric shaft portion 14 and the rolling piston 22 further proceeds, communication of the compression chamber 26*b* with the outlet port is interrupted and the compression chamber 26*b* communicates with the suction port 29 again, and thereafter the compression chamber 26*b* functions as the suction chamber 26*a*.

Figure 8:
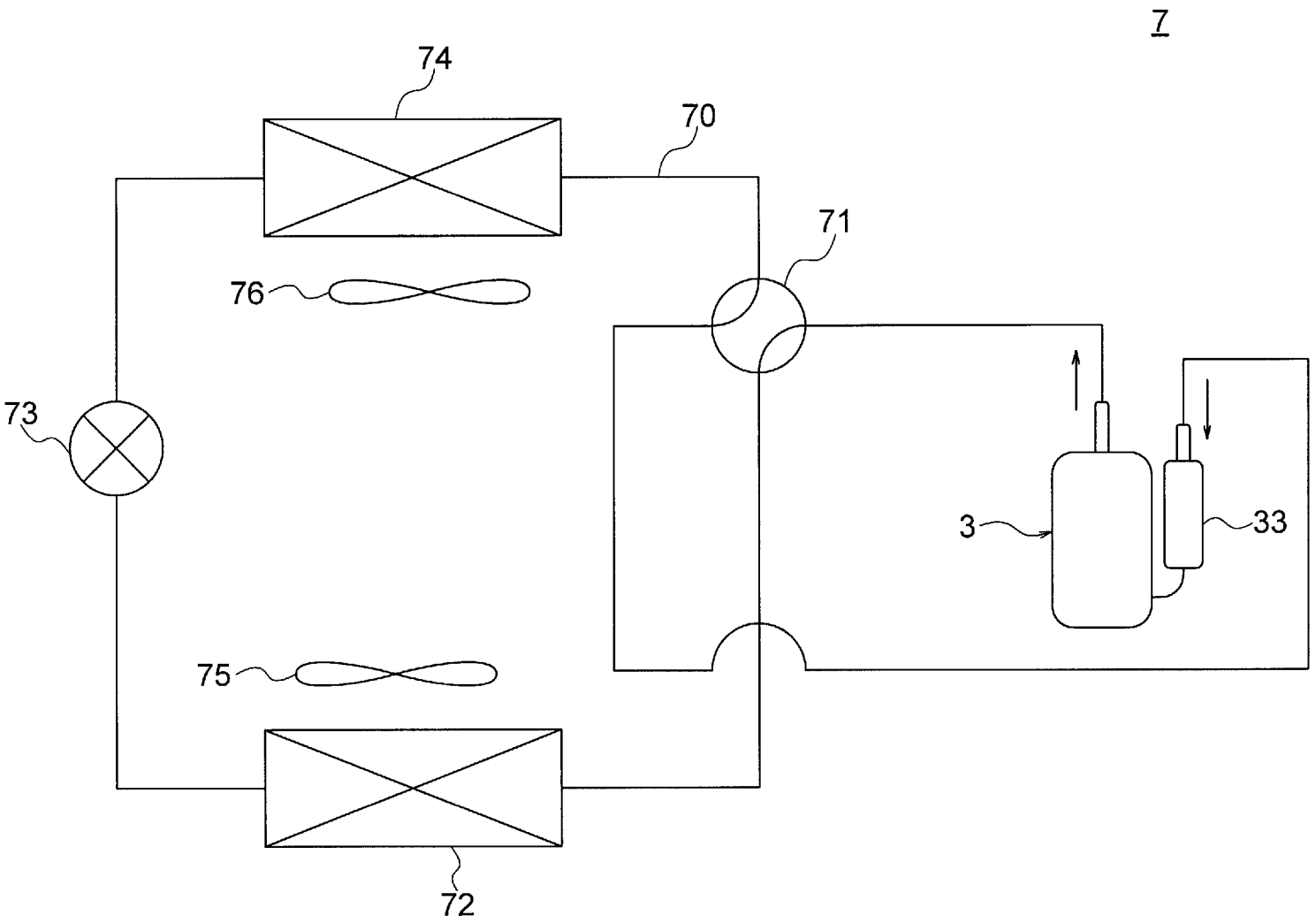
FIG. 8 is a view illustrating a configuration of an air conditioner to which the compressor according to each embodiment is applicable.

The refrigerant compressed in the cylinder chamber 26 passes through discharge mufflers 27 and 28, then passes through the gap between the rotor 4 and the stator 5 and the gap between the stator 5 and the closed container 32, and then flows upward in the closed container 32. The refrigerant flowing upward in the closed container 32 is discharged through the discharge pipe 35, and is sent to the refrigerant circuit in the air conditioner 7 (FIG. 8).

(Action)

In a case where the rotor 4 is eccentrically attached to the rotation shaft 10 because of a variation in assembling or the like, a gap between the rotor 4 and the stator 5 may be non-uniform in the circumferential direction, and a magnetic attraction force may occur between the rotor 4 and the stator 5. If the rotor 4 has an imbalance in a mass distribution, a large centrifugal force may be exerted on the rotor 4. These forces cause whirling of the rotor 4 in high-speed operation.

Since the rotation shaft 10 is supported at an end thereof by the bearing portions 23*b* and 24*b* of the compression mechanism portion 31, a force is exerted on the rotation shaft 10 so as to deflect the rotation shaft 10 about the bearing portions 23*b* and 24*b* as a fulcrum.

In the first embodiment, the first shaft portion 11 of the rotation shaft 10 is composed of a material having a higher Young's modulus than that of cast iron. Thus, rigidity of the rotation shaft 10 can be increased, and deflection of the rotation shaft 10 due to the magnetic attraction force and the centrifugal force can be suppressed.

Accordingly, even when the rotor 4 is rotated at a high speed of, for example, 7800 rpm or more, vibration and noise of the compressor 3 can be reduced. That is, the highly-reliable and high-power compressor 3 can be obtained.

By increasing the rigidity of the rotation shaft 10, the outer diameter of the rotation shaft 10 can be reduced, and the capacity of the cylinder chamber 26 can be increased. The reduction of the outer diameter of the rotation shaft 10 reduces the sliding loss between the rotation shaft 10 and the bearing portions 23*b* and 24*b*, and thus a temperature rise of the compressor 3 can be suppressed.

While the rotor 4 rotates at high speed, heat is generated by an iron loss in the rotor core 40, an eddy-current loss in the permanent magnets 45, and the sliding loss (friction) between the bearing portions 23*b* and 24*b* and the rotation shaft 10. Since the first shaft portion 11 of the rotation shaft 10 is composed of a material having a higher thermal conductivity than that of cast iron, heat is dissipated through the rotation shaft 10, and the temperature rise of the compressor 3 can be suppressed. Meanwhile, heat dissipated from the rotation shaft is released to the outside through the discharge pipe 35 together with the refrigerant.

While the rotor 4 rotates, heat is generated by the eddy-current loss in the permanent magnets 45, but is dissipated through the rotation shaft 10 so that a temperature rise of the permanent magnets 45 can be suppressed. The rare earth magnet constituting the permanent magnets 45 is likely to be demagnetized as the temperature increases, but the demagnetization of the permanent magnets 45 can be suppressed by suppressing the temperature rise of the permanent magnets 45.

Since the second shaft portion 12 of the rotation shaft 10 is composed of iron such as cast iron, an excellent sliding characteristic between the rotation shaft 10 and the bearing portions 23*b* and 24*b* composed of iron such as cast iron can be maintained. That is, rigidity of the rotation shaft 10 can be increased without impairing the sliding characteristic between the rotation shaft 10 and the bearing portions 23*b* and 24*b*.

In a cross section perpendicular to the axial direction, the outer diameter D1 of the first shaft portion 11 is smaller than 90% of the outer diameter D0 of the rotation shaft 10 ($D1<0.9\times D0$). Since the thickness of the second shaft portion 12 is not excessively thin, the second shaft portion 12 can be prevented from separating from the first shaft portion 11.

In addition, deflection of the rotation shaft 10 is suppressed as described above, and thus, even in the case where the outer diameter of the rotation shaft 10 is made small, adhesive wear and galling (scuffing) of the rotation shaft 10 can be suppressed. That is, a mechanical loss in the compressor can be reduced, and the highly efficient and small-sized compressor 3 can be obtained.

As described above, the outer diameter Dr of the rotor core 40 is smaller than or equal to the inner diameter Ds of the cylinder chamber 26 (FIG. 4). Since the outer diameter Dr of the rotor core 40 is not excessively large as described above, a centrifugal force during high-speed rotation of the rotor 4 can be reduced. The length Lr of the rotor core 40 in the axial direction is longer than the outer diameter Dr of the rotor core 40. As the length Lr of the rotor core 40 increases, the length of each permanent magnet 45 increases. Thus, a magnetic force of the permanent magnets 45 increases, and a torque increases. Accordingly, a sufficient torque corresponding to a stroke volume of the compression mechanism portion 31 can be generated. As a result, the motor 6 can be driven at high speed with high torque.

As described above, the length Lr of the rotor core 40 in the axial direction is preferably longer than or equal to the length Ls of the cylinder 21 of the compression mechanism portion 31 in the axial direction, and more preferably longer than or equal to twice the length Ls of the cylinder 21 in the axial direction. As the length of the rotor core 40 in the axial direction increases, the length of each permanent magnets in the axial direction increases and a magnetic force increases. Thus, a torque increases. As a result, even when a compression load increases as in a case where the stroke volume of the compression mechanism portion 31 is, for example, 200 cc or more, a torque corresponding to the compression load can be generated. In addition, a load variation of the compression mechanism portion 31 due to a torque insufficiency of the motor 1 can be suppressed.

As described above, the rotor 4 includes the holding portion 46 covering the outer circumference of the rotor core 40. The holding portion 46 is composed of, for example, carbon fiber reinforced plastic, stainless steel, or a resin. Since the holding portion 46 is provided, rigidity of the rotor 4 can be increased. Accordingly, the rotor 4 can rotate at high speed without degradation of performance of the motor 6, and an output of the motor 6 can be increased.

The holding portion 46 is preferably composed of a non-magnetic material. Specifically, the holding portion 46 is preferably composed of nonmagnetic carbon fiber reinforced plastic, nonmagnetic stainless steel, or a nonmagnetic resin. When the holding portion 46 is composed of the non-magnetic material, leakage magnetic flux between adjacent magnetic poles of the rotor 4 can be reduced, and a magnetic force of the rotor 4 can be further increased. In addition, an increase of an eddy current in the rotor 4 can be suppressed.

A linear expansion coefficient of the holding portion 46 is preferably smaller than a linear expansion coefficient of the rotor core 40. For example, in a case where the holding portion 46 is composed of carbon fiber reinforced plastic, the linear expansion coefficient of the holding portion 46 is smaller than a linear expansion coefficient of electromagnetic steel sheets constituting the rotor core 40. Accordingly, a change in the gap between the rotor 4 and the stator 5 with temperature can be suppressed.

Since the carbon fiber reinforced plastic has high strength, the holding portion 46 can be made thin when the holding portion 46 is composed of carbon fiber reinforced plastic. Accordingly, the gap between the rotor 4 and the stator 5 can be reduced, and the magnetic force of the permanent magnets 45 can be effectively used. As a result, the rotation speed of the rotor 4 can be increased, and motor efficiently can be enhanced.

Advantages of Embodiment

As described above, the compressor 3 according to the first embodiment includes the motor 6, the compression mechanism portion 31 driven by the motor 6, and the rotation shaft 10 connecting the motor 6 and the compression mechanism portion 31. The first shaft portion 11 of the rotation shaft 10 is composed of a material having a higher Young's modulus than that of cast iron, and having a higher thermal conductivity than that of cast iron. Thus, rigidity of the rotation shaft 10 can be increased and deflection of the rotation shaft 10 can be suppressed. Thus, vibration and noise can be reduced. Further, due to the heat dissipation effect through the rotation shaft 10, a temperature rise of the compressor 3 can be suppressed. As a result, the motor 6 can be driven at high speed with high torque, and an output of the compressor 3 can be increased.

In particular, since the first shaft portion 11 is composed of carbon fiber reinforced plastic, rigidity and heat dissipation property of the rotation shaft 10 can be further enhanced, and the output of the compressor 3 can be further increased.

In addition, the rotation shaft 10 includes the eccentric shaft portion 14 which is eccentric with respect to the axis C1. The compression mechanism portion 31 includes the rolling piston 22 attached to the eccentric shaft portion 14, and the cylinder including the cylinder chamber 26 in which the eccentric shaft portion 14 and the rolling piston 22 are disposed. Thus, rotation of the rotation shaft 10 causes eccentric rotation of the eccentric shaft portion 14 and the rolling piston 22 in the cylinder chamber 26 so as to compress the refrigerant.

The rotation shaft 10 includes the first shaft portion 11 on the inner side in the radial direction, and the second shaft portion 12 on the outer side of the first shaft portion 11 in the radial direction. The first shaft portion 11 is made of a material, such as carbon fiber reinforced plastic, having a higher Young's modulus than that of cast iron and a higher thermal conductivity than that of cast iron. Thus, rigidity and heat dissipation property of the rotation shaft 10 can be enhanced In addition, since the second shaft portion 12 is composed of iron, more specifically, cast iron, an excellent sliding characteristic between the rotation shaft 10 and the bearing portions 23*b* and 24*b* can be obtained, and a sliding loss can be suppressed.

Since the first shaft portion 11 and the second shaft portion 12 extend from one end to the other end of the rotation shaft 10 in the axial direction, it is not necessary to provide the rotation shaft 10 with a joint portion at which different materials are joined in the axial direction. Accordingly, rigidity of the entire rotation shaft 10 can be increased.

Since the rotor 4 includes the rotor core 40 and the permanent magnets 45 and the permanent magnets 45 are rare earth magnets, a high torque can be generated.

Since the rotor 4 includes the holding portion 46 that holds the rotor core 40 from the outer side in the radial direction, the rigidity of the rotor 4 can be increased, and the rotation speed of the rotor 4 can be increased.

In addition, since the holding portion 46 is composed of a non-magnetic material, leakage magnetic flux between adjacent magnetic poles of the rotor 4 can be reduced. As a result, a magnetic force of the permanent magnets 45 of the rotor 4 can be further increased, and a higher torque can be generated.

Second Embodiment

Figure 5:
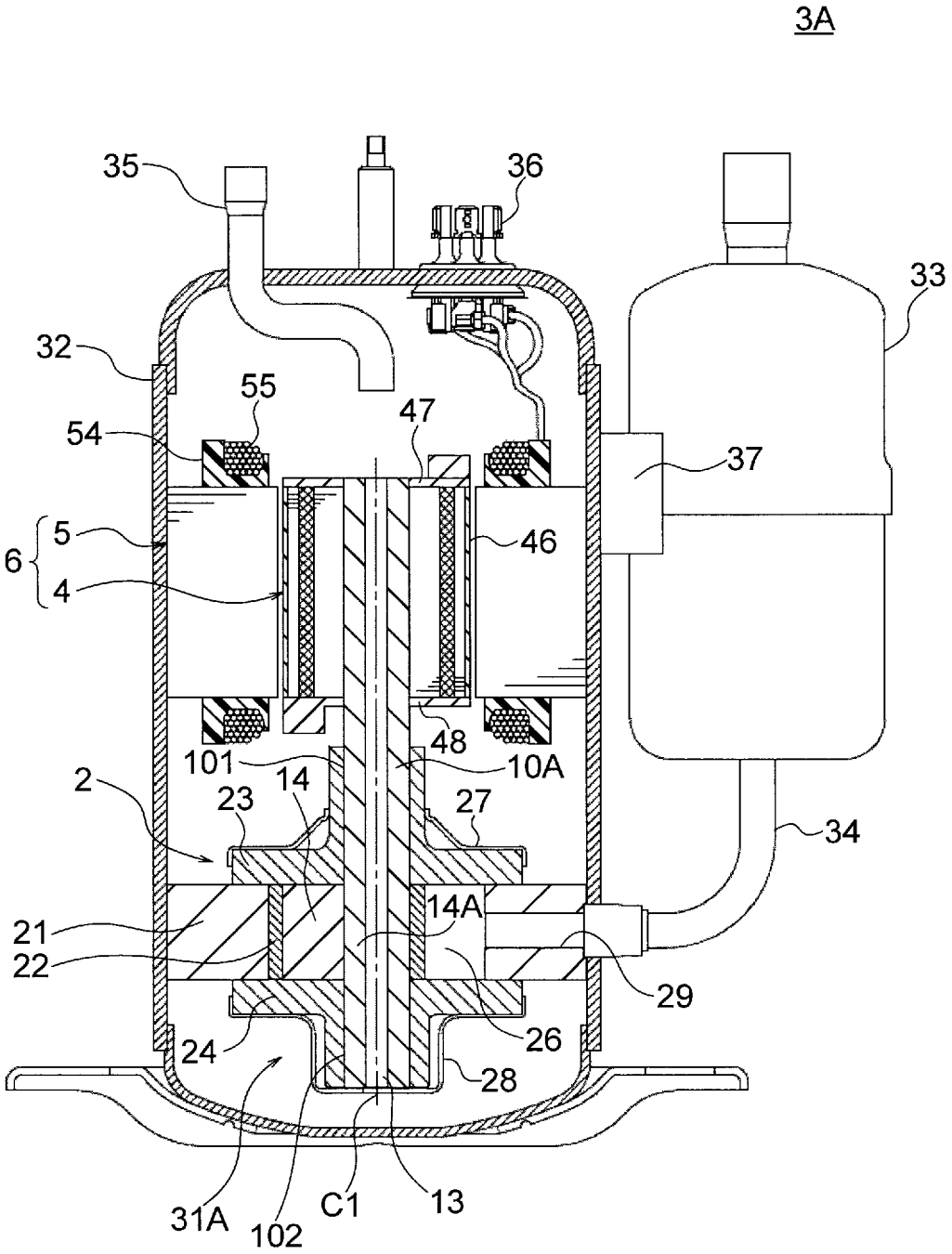
FIG. 5 is a longitudinal sectional view illustrating a compressor according to a second embodiment.
Figure 6:
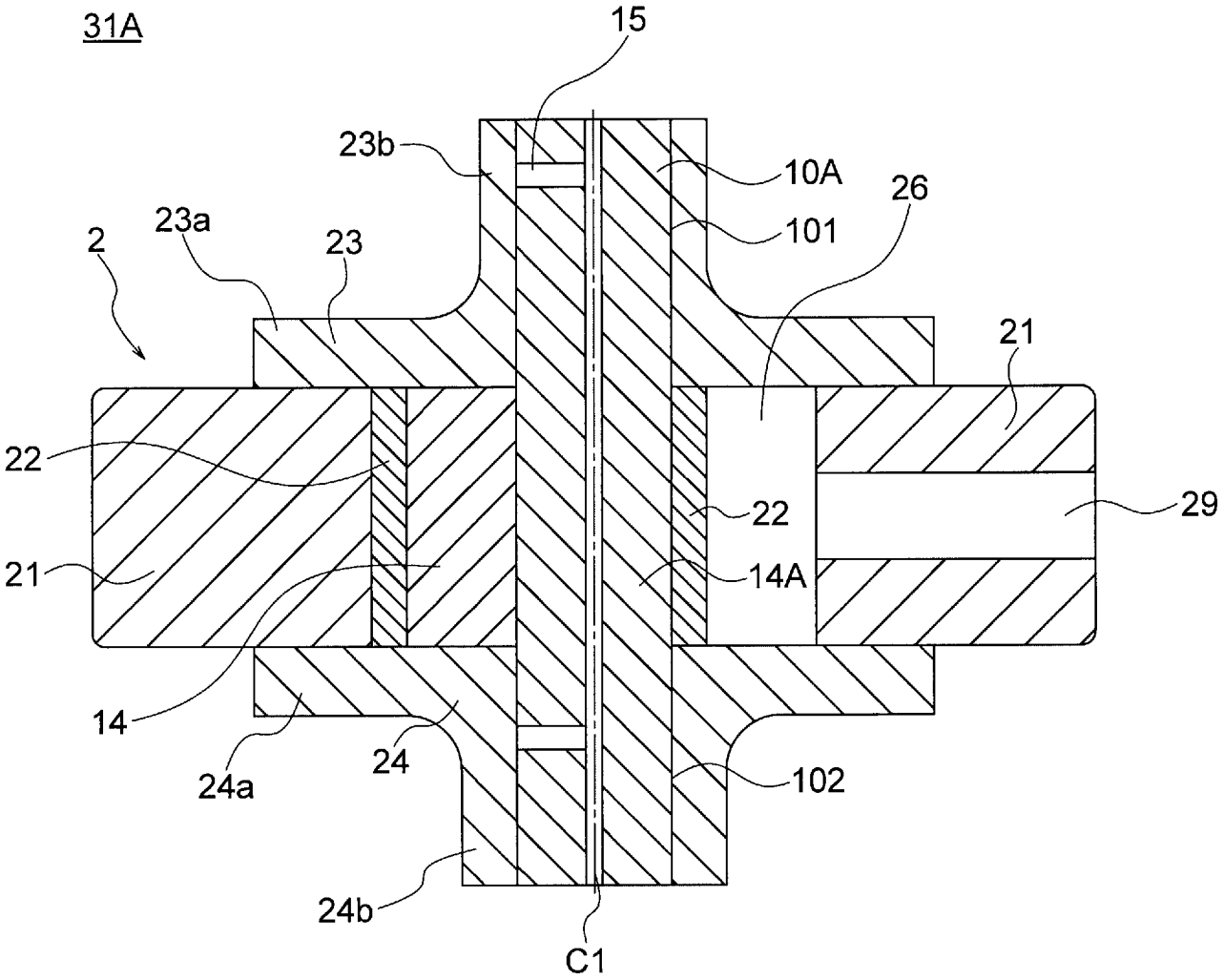
FIG. 6 is a longitudinal sectional view illustrating a compression mechanism portion according to the second embodiment.

FIG. 5 is a longitudinal sectional view illustrating a compressor 3A according to a second embodiment. FIG. 6 is a longitudinal sectional view illustrating a compression mechanism portion 31A of the compressor 3A according to the second embodiment. The compressor 3A of the second embodiment is different from the compressor 3 of the first embodiment in the configuration of a rotation shaft 10A.

In the rotation shaft 10A of the second embodiment, each of a main shaft portion 101 and an auxiliary shaft portion 102 is composed of a material whose Young's modulus and thermal conductivity are higher than those of cast iron. In addition, a center portion 14A of an eccentric shaft portion 14, that is, a portion having the same sectional shape as that of each of the main shaft portion 101 and the auxiliary shaft portion 102, is composed of a material whose Young's modulus and thermal conductivity are higher than those of cast iron.

The main shaft portion 101 and the auxiliary shaft portion 102 of the rotation shaft 10A and the center portion 14A of the eccentric shaft portion 14 are composed of, for example, carbon fiber reinforced plastic. A portion of the eccentric shaft portion 14 except for the center portion 14A is composed of iron such as cast iron.

The rotation shaft 10A having the configuration described above is made by inserting a shaft portion composed of, for example, carbon fiber reinforced plastic into the eccentric shaft portion 14 composed of a casting of cast iron so that the shaft portion serves as a core rod.

In the second embodiment, the main shaft portion 101 and the auxiliary shaft portion 102 of the rotation shaft 10A and the center portion 14A of the eccentric shaft portion 14 are composed of the material whose Young's modulus and thermal conductivity are higher than those of cast iron, and thus rigidity and heat dissipation property of the rotation shaft 10A can be further enhanced. As a result, vibration and noise of the compressor 3A can be reduced, a temperature rise of the compressor 3A can be suppressed, and an output of the compressor 3A can be further increased.

Third Embodiment

Figure 7:
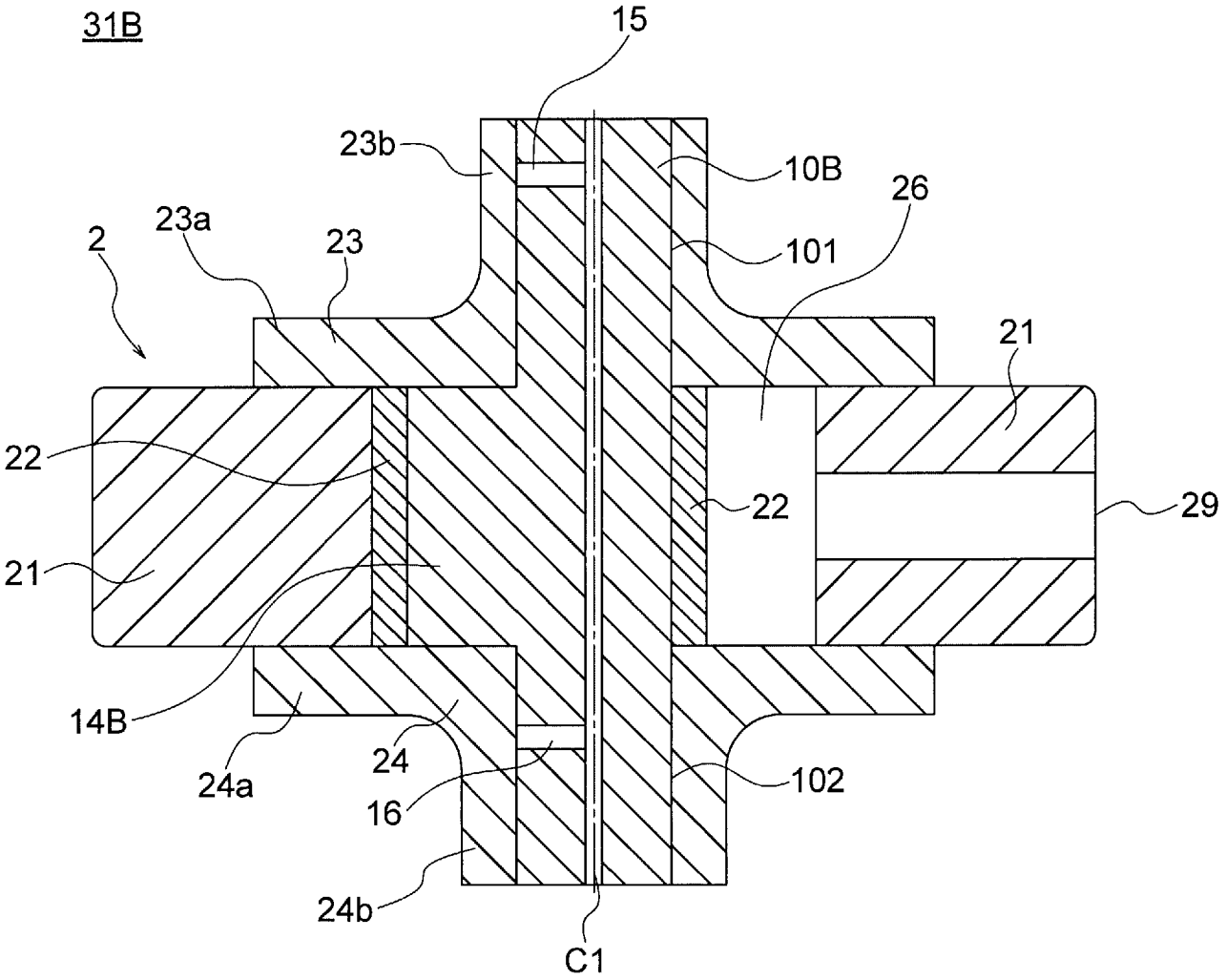
FIG. 7 is a longitudinal sectional view illustrating a compression mechanism portion according to a third embodiment.

FIG. 7 is a longitudinal sectional view illustrating a compression mechanism portion 31B of a compressor 3B according to a third embodiment. The compressor 3B of the third embodiment is different from the compressor 3 of the first embodiment in the configuration of a rotation shaft 10B.

In the third embodiment, the entire rotation shaft 10B including a main shaft portion 101, an auxiliary shaft portion 102, and an eccentric shaft portion 14 is composed of a material whose Young's modulus and thermal conductivity are higher than those of cast iron. More specifically, the entire rotation shaft 10B is composed of, for example, carbon fiber reinforced plastic.

The rotation shaft 10B described above is made by forming a molded body including the main shaft portion 101, the auxiliary shaft portion 102, and the eccentric shaft portion 14 using carbon fiber reinforced plastic by injection molding, and polishing the molded body to form sliding surfaces that slide with the bearing portions 23*b* and 24*b*.

In the third embodiment, the entire rotation shaft 10B is composed of the material whose Young's modulus and thermal conductivity are higher than those of cast iron, and thus rigidity and heat dissipation property of the rotation shaft 10B can be further enhanced. As a result, vibration and noise of the compressor 3B can be reduced, a temperature rise of the compressor 3B can be suppressed, and an output of the compressor 3B can be further increased.

In the first through third embodiments described above, the entire rotation shaft 10 (10A, 10B) from one end to the other end in the axial direction is composed of the material whose Young's modulus and thermal conductivity are higher than those of cast iron. However, it is sufficient that at least a part of the rotation shaft 10 (10A, 10B) located inside the compression mechanism portion 31 (31A, 31B) is composed of the material whose Young's modulus and thermal conductivity are higher than those of cast iron.

(Air Conditioner)

Next, an air conditioner 7 (also referred to as a refrigeration air conditioning apparatus) to which the compressor 3 of each of the embodiments described above is applicable. FIG. 8 is a view illustrating a configuration of the air conditioner 7. The air conditioner 7 illustrated in FIG. 8 includes the compressor 3 of the first embodiment, a four-way valve 71 as a switching valve, a condenser 72, a decompressor 73, an evaporator 74, and a refrigerant pipe 70. The compressor 3, the condenser 72, the decompressor 73, and the evaporator 74 are connected by the refrigerant pipe 70, and constitute a refrigerant circuit. The compressor 3 includes an outdoor fan 75 facing the condenser 72, and an indoor fan 76 facing the evaporator 74.

An operation of the air conditioner 7 is as follows. The compressor 3 compresses sucked refrigerant and sends the compressed refrigerant as high-temperature and high-pressure gas refrigerant. The four-way valve 71 is configured to switch a flow direction of the refrigerant, and causes the refrigerant sent from the compressor 3 to flow into the condenser 72 as illustrated in FIG. 8 in a cooling operation. The condenser 72 performs heat exchange between the refrigerant sent from the compressor 3 and outdoor air sent by the outdoor fan 75, condenses the refrigerant, and sends the condensed refrigerant as liquid refrigerant. The decompressor 73 expands the liquid refrigerant sent from the condenser 72 and sends the refrigerant as low-temperature and low-pressure liquid refrigerant.

The evaporator 74 performs heat exchange between the low-temperature and low-pressure liquid refrigerant sent from the decompressor 73 and indoor air, evaporates (vaporizes) the refrigerant, and sends the refrigerant as gas refrigerant. Air from which heat is taken in the evaporator 74 is supplied to a room that is space to be air-conditioned, by the indoor fan 76.

In a heating operation, the four-way valve 71 causes the refrigerant sent from the compressor 3 to flow into the evaporator 74. In this case, the evaporator 74 functions as a condenser, and the condenser 72 functions as an evaporator.

As described in the first embodiment, the compressor 3 of the air conditioner 7 reduces vibration and noise and achieves high output by suppression of the temperature rise. Accordingly, quietness of the air conditioner 7 can be enhanced, and operation efficiency of the air conditioner 7 can be enhanced.

The compressor of the first embodiment may be replaced by the compressor of the second or third embodiment. Components except the compressor 3 in the air conditioner 7 are not limited to those used in the configurations described above.

Although preferred embodiments of the present invention have been specifically described above, the present invention is not limited to these embodiments, and various improvements and modifications may be made without departing from the scope of the invention.

What is claimed is:

1. A compressor comprising:

a motor;

a compression mechanism driven by the motor; and a rotation shaft connecting the motor and the compression mechanism, the rotation shaft having an eccentric shaft portion which is eccentric with respect to a rotation center of the rotation shaft, wherein the compression mechanism has a rolling piston attached to the eccentric shaft portion, a cylinder chamber in which the eccentric shaft portion and the rolling piston are disposed, and a bearing portion supporting the rotation shaft, wherein the motor has a rotor fixed to the rotation shaft, wherein an outer diameter Dr of the rotor in a radial direction about the rotation center of the rotation shaft and an inner diameter Ds of the cylinder chamber in the radial direction satisfy Dr<Ds, wherein the rotation shaft has a first shaft portion on an inner side in a radial direction about a rotation center of the rotation shaft, and has a second shaft portion on an outer side of the first shaft portion in the radial direction, the first shaft portion and the second shaft portion being different from each other in material, wherein the first shaft portion is composed of a carbon fiber reinforced plastic including pitch carbon fibers having a fiber length of 50 μm to 3 μm and a thermoplastic resin, wherein the carbon fiber reinforced plastic having a range of a higher Young's modulus between 300 GPa to 900 GPa than a range of a Young's modulus of cast iron and having a higher thermal conductivity between 150 W/mk to 900 W/mk than a range of a thermal conductivity of cast iron, wherein the second shaft portion is composed of a cast iron, and wherein each of the first shaft and the second shaft portion extends from one end to the other end of the rotation shaft in an axial direction of the rotation shaft.

2. The compressor according to claim 1, wherein at least a part of the rotation shaft is composed of carbon fiber reinforced plastic.

3. The compressor according to claim 1, wherein when D0 represents an outer diameter of the rotation shaft in the radial direction and D1 represents an outer diameter of the first shaft portion in the radial direction, D1<0.9×D0 is satisfied.

4. The compressor according to claim 1, wherein the second shaft portion is composed of iron.

5. The compressor according to claim 4, wherein a length of the rotor in an axial direction of the rotation shaft is longer than or equal to a length of the cylinder in the axial direction.

6. The compressor according to claim 4, wherein an outer diameter of the rotor is smaller than a length of the rotor in an axial direction of the rotation shaft.

7. The compressor according to claim 1, wherein the rotor has a rotor core and a permanent magnet attached to the rotor core.

8. The compressor according to claim 7, wherein the permanent magnet is a rare earth magnet.

9. The compressor according to claim 7, wherein the rotor has a holding portion that holds the rotor core from an outer side in a radial direction about the rotation center of the rotation shaft.

10. The compressor according to claim 9, wherein the holding portion is composed of carbon fiber reinforced plastic, stainless steel, or a resin.

11. The compressor according to claim 9, wherein the holding portion is composed of a non-magnetic material.

12. The compressor according to claim 1, wherein the motor is disposed above the compression mechanism.

13. An air conditioner comprising:

the compressor according to claim 1;

a condenser to condense refrigerant sent from the compressor;

a decompressor to decompress the refrigerant condensed by the condenser; and an evaporator to evaporate the refrigerant decompressed by the decompressor.

* * * * *